United States Patent [19]

Lin

[11] Patent Number: 5,045,986

[45] Date of Patent: Sep. 3, 1991

[54] STRUCTURE OF DESK LAMP

[76] Inventor: Jack Lin, 4F, No. 112, Wen Lin North Rd., Taipei, Taiwan

[21] Appl. No.: 620,121

[22] Filed: Nov. 30, 1990

[51] Int. Cl.[5] ..... F21V 21/26

[52] U.S. Cl. ..... 362/413; 362/419; 362/427

[58] Field of Search ..... 362/410, 413, 414, 418, 362/419, 427, 269, 265

[56] References Cited

U.S. PATENT DOCUMENTS

| | | | |
|---|---|---|---|
| 4,630,185 | 12/1986 | Copeland | 362/419 |
| 4,772,993 | 9/1988 | Engel | 362/419 |
| 4,819,138 | 4/1989 | Polick | 362/419 |
| 4,974,135 | 11/1990 | Wen-Tsung | 362/413 |

*Primary Examiner*—Ira S. Lazarus
*Assistant Examiner*—Richard R. Cole
*Attorney, Agent, or Firm*—Lowe, Price, LeBlanc & Becker

[57] ABSTRACT

A desk lamp including a lamp holder connected to a rotary stand by way of a connecting rod assembly. The lamp holder is allowed to rotate on its own axis. The rotary stand is revolvably fastened to a base. The connecting rod assembly includes two rods which are set in parallel with each other and can be relatively moved to adjust the angle of the lamp holder. By way of the rotation of the lamp holder and the rotary stand and through the control of the connecting rod assembly, the projecting angle of the illumination of the lamp can be conveniently adjusted in all directions.

2 Claims, 5 Drawing Sheets

STRUCTURE OF DESK LAMP

BACKGROUND OF THE INVENTION

The present invention is related to a desk lamp and more particularly to the one in which the lamp holder can be conveniently adjusted in all directions.

In the variety of conventional desk lamps, the projection angle of a lamp is generally adjusted by means of connecting rods, i.e. the change of angular position of a lamp is confined to the moving range of the associated connecting rods.

SUMMARY OF THE INVENTION

In an embodiment of the present invention, a desk lamp includes a lamp holder connected to a rotary stand by means of connecting rod assembly. The lamp holder is allowed to rotate on its own axis. The rotary stand is revolvably fastened to a base. The connecting rod assembly includes two rods which are set in parallel with each other and can be relatively moved forward and backward to adjust the angle of the lamp holder. By means of the rotation of the lamp holder and the rotary stand and through the control of the connecting rod assembly, the projecting angle of the illumination of the lamp can be conveniently adjusted in all directions.

DESCRIPTION OF THE PREFERRED EMBODIMENTS

Figure 1:
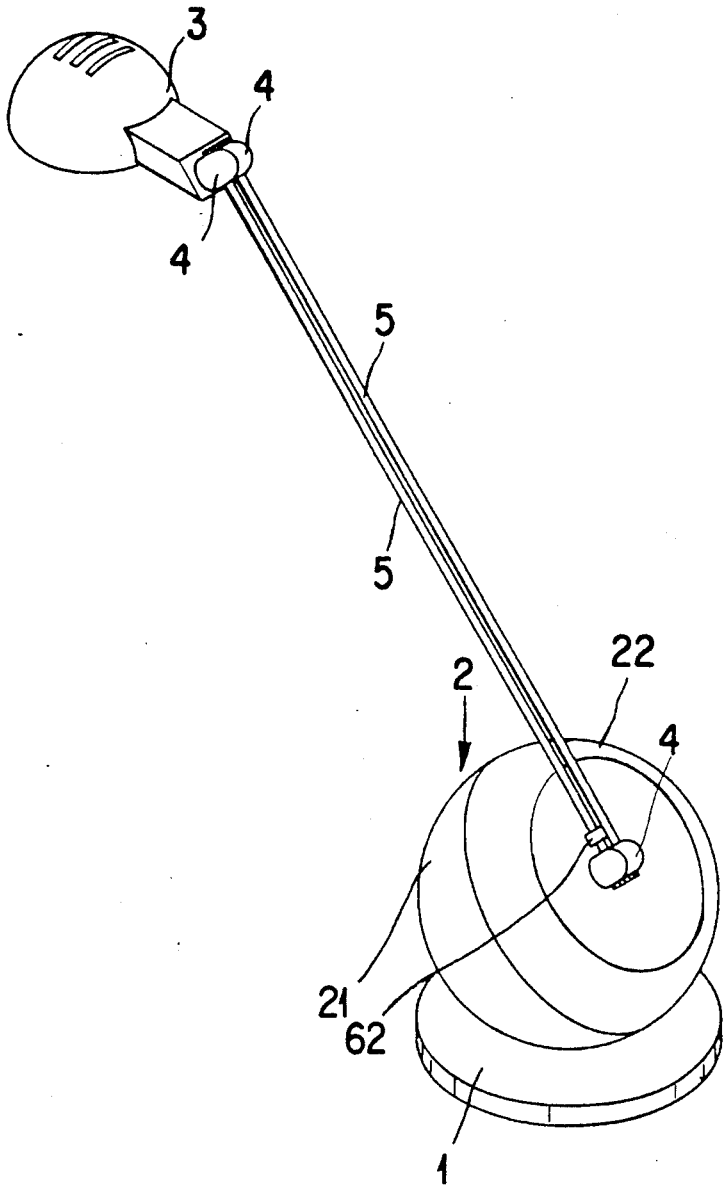
FIG. 1 is a perspective view illustrating the outer configuration of a desk lamp constructed according to the present invention.
Figure 2:
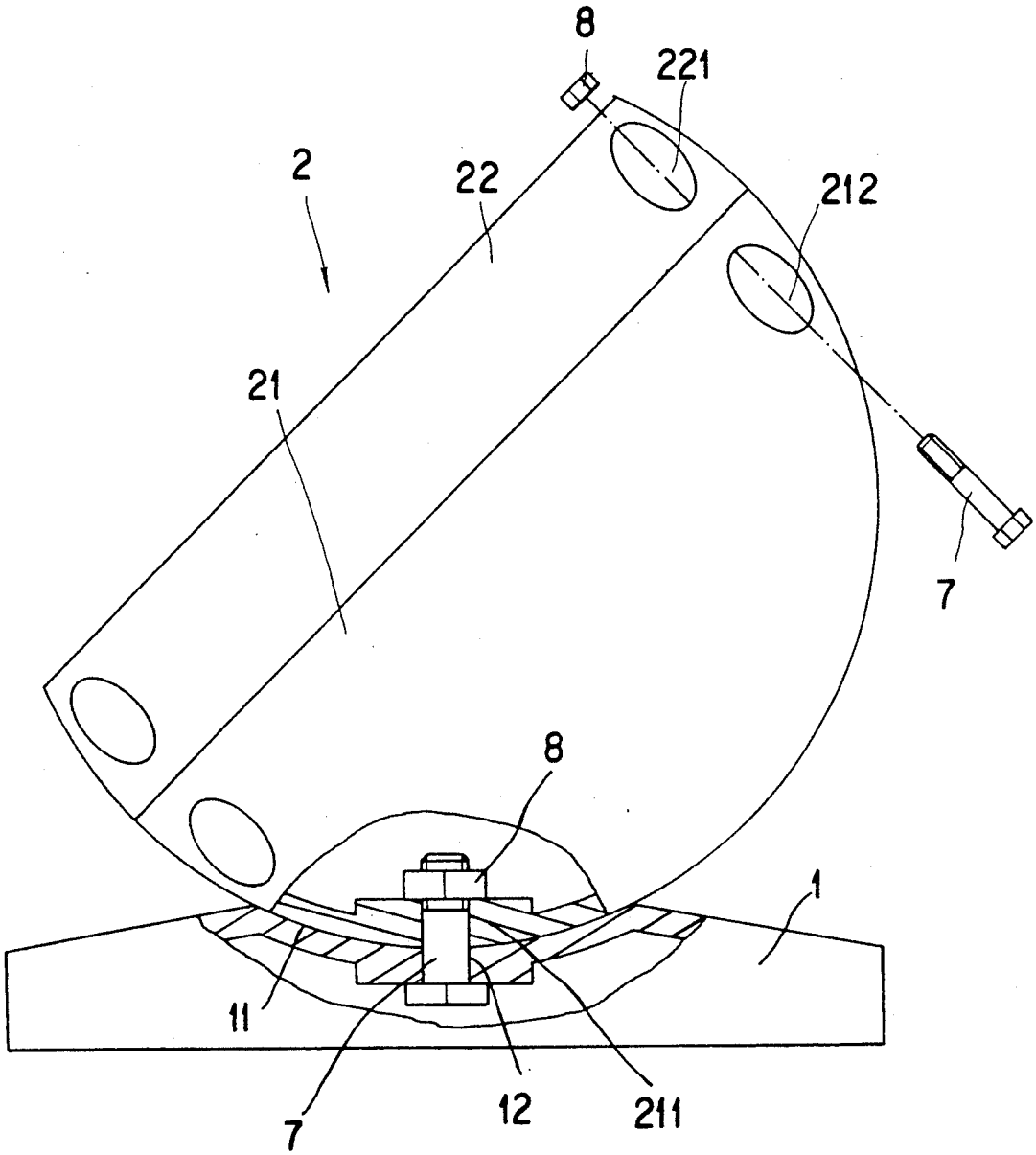
FIG. 2 is a plan sectional view illustrating the positioning of the rotary stand in the base of the embodiment of FIG. 1.
Figure 3:
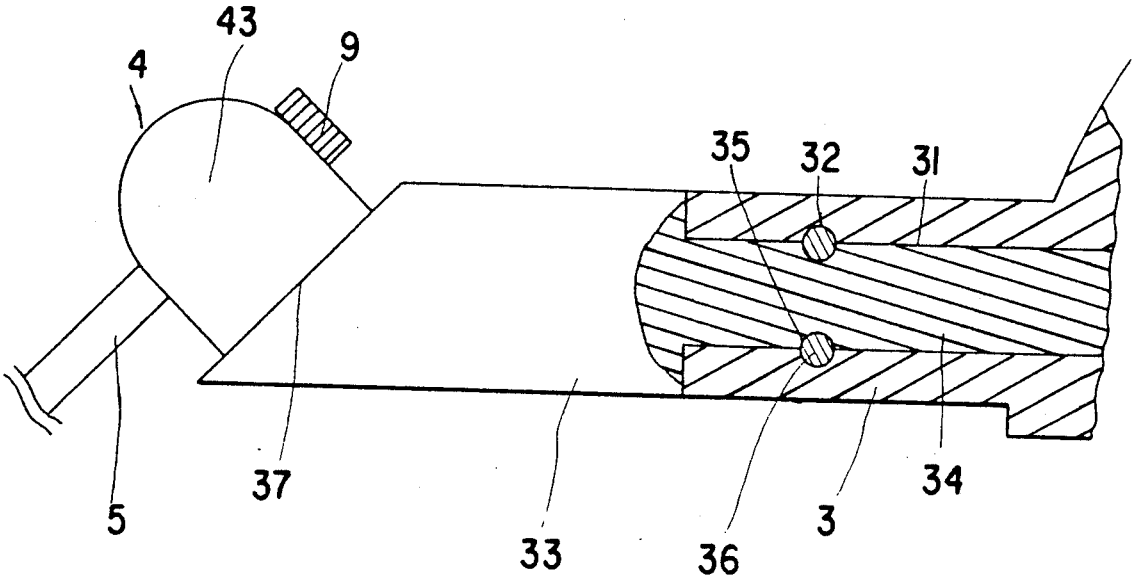
FIG. 3 is a plan sectional view illustrating the structure of the lamp holder of the embodiment of FIG. 1.
Figure 4:
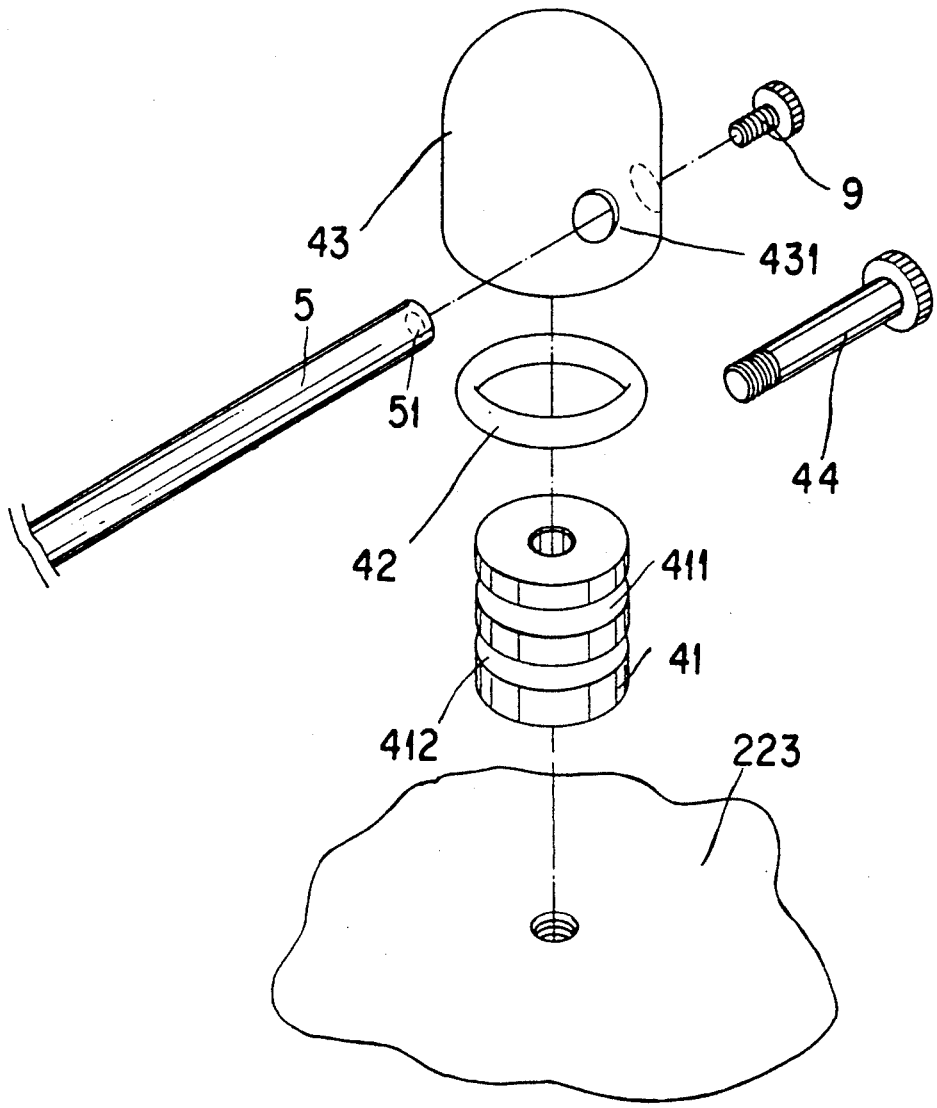
FIG. 4 is a fragmentary perspective view of a rotary connector according to the present invention.
Figure 5:
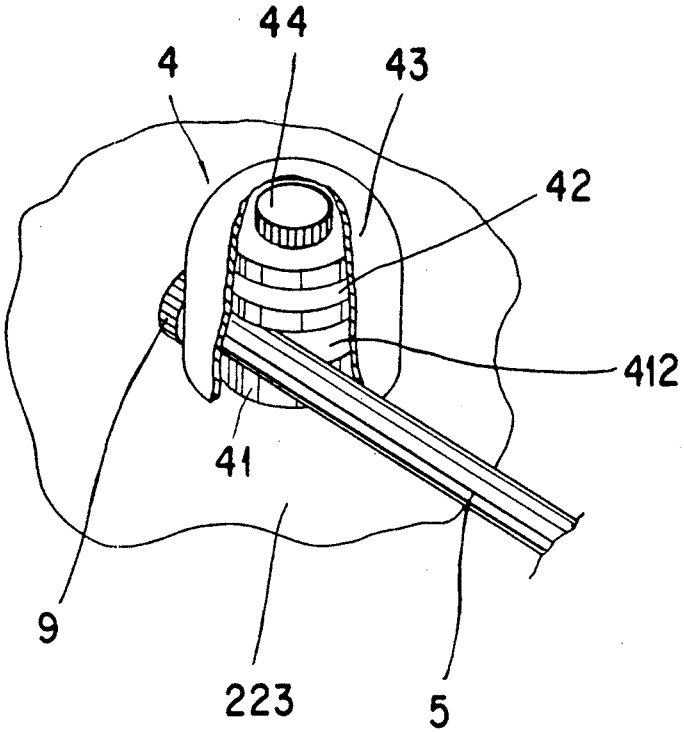
FIG. 5 is a perspective and partly sectional view illustrating the connection of a rod of the connecting rod assembly to a rotary connector.
Figure 6:
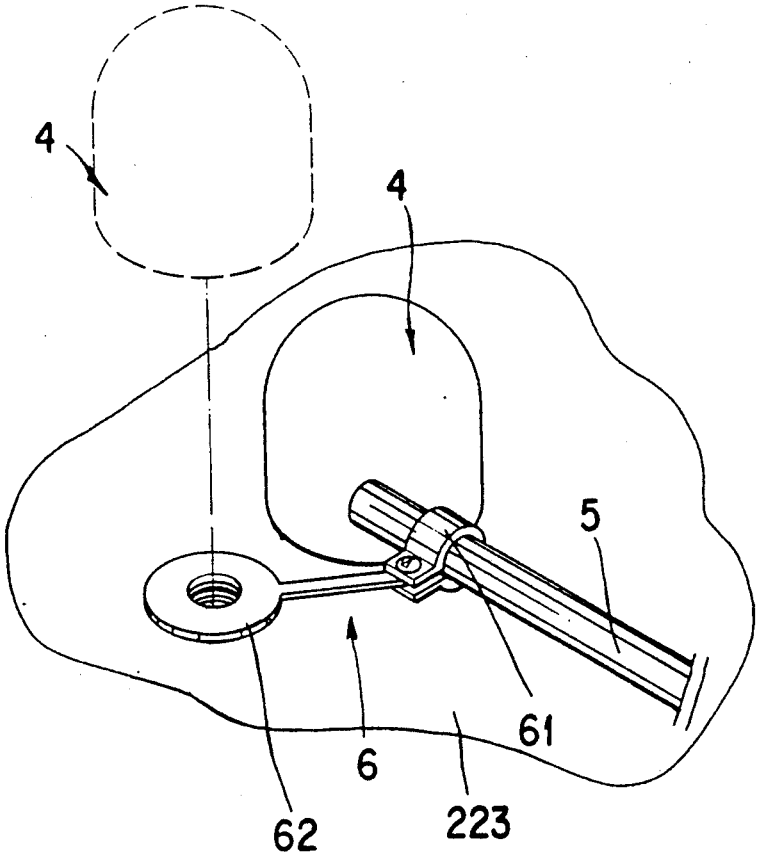
FIG. 6 illustrates the mounting of a link gear on a rod of the connecting rod assembly and a rotary connector.

Turning now to the annexed drawings in greater detail, therein illustrated is a desk lamp in accordance with the present invention and generally comprised of a base (1), a rotary stand (2), a lamp holder (3), two pairs of rotary connectors (4), a connecting rod assembly (5) and a pair of link gears (6).

The base (1) comprises a circular recess (11) in its center having a round hole (12) thereon.

The rotary stand (2) is generally comprised of a hemispherical shell (21) and a cap (22). The hemispherical shell (21) has a round hole (211) corresponding to the round hole (12) of the circular recess (11) of the base (1) for the fastening thereto of a bolt (7) and a nut (8) to secure the hemi-spherical shell (21) to the base (1) permitting the hemi-spherical shell (21) to rotate through an angle of 360° relative to the base (1), and a plurality of positioning holes (212) corresponding to a plurality of positioning holes (221) on the cap (22) for the fastening thereto of bolts (7) and nuts (8) to secure the cap (22) to the hemi-spherical shell (21). The cap (22) also comprises a plane surface (223) having a bolt hole (222) thereon.

The lamp holder (3) has an axial hole (31) therethrough and an internal circular groove (32) on its axial hole (31). An axle (33) which comprises a front rod portion (34) in relatively smaller diameter is secured to the lamp holder (3) in such a manner that the front rod portion (34) which comprises a circular groove (35) having a rubber ring (36) thereon is inserted in the axial hole (31) with its rubber ring (36) set in the internal circular groove (32) permitting the lamp holder (3) to rotate through an angle of 360° relative to the axle (33). The axle (33) includes a plane surface (37) having a bolt hole (38) thereon.

The two pairs of rotary connectors (4) each pair are respectively fastened to the plane surface (223) and (37) of the cap (22) and the axle (33), each comprising an axle sleeve (41), a rubber ring (42) mounted on the axle sleeve (41), and a shielding cover (43) covering on the axle sleeve (41). During assembly, the axle sleeve (41) of each rotary connector (4) is secured to the plane surface (223) or (37) of the cap (22) or the axle (33) by a lock bolt (44). The axle sleeve (41) of each rotary connector (4) comprises two circular grooves (411) and (412), in which the upper circular groove (411) has a rubber ring (42) thereon, the lower circular groove (412) is for the positioning of the connecting rod assembly (5). The shielding cover (43) of each rotary connector (4) comprises two opposite axial holes (431) for the insertion therein of the connecting rod assembly (5) to movably position in the lower circular groove (412) of the axle sleeve (41).

The connecting rod assembly (5) is comprised of two rods in parallel with each other and each rod of which has bolt holes (51) on its both bottom ends. When the connecting rod assembly (5) is inserted in the axial holes (431) of the rotary connectors (4) screw bolts (9) are used to respectively screw up with the bolt holes (51) so as to secure the connecting rod assembly (5) to the rotary connectors (4).

The two link gears (6) each is comprised of a clamp (61) and a retainer plate (62) wherein the clamp (61) is mounted on the first rod of the connecting rod assembly (5), and the retainer plate (62) is secured to the bottom of a rotary connector (4) to which the other rod of the connecting rod assembly (5) is secured. The retainer plates (62) of the link gears (6) are secured to the sockets (41) of corresponding rotary connectors (4) respectively by means of lock bolts (44).

As described above, the positioning of the axle (33) in the lamp holer (3) is reinforced by means of the rubber ring (36) so that the lamp holder (3) can be rotated through an angle of 360° relative to the axle (33) to change its angle of illumination. Because the rotary stand (2) can be rotated through an angle of 360° relative to the base (1), during the rotation of the rotary stand (2), the connecting rod assembly (5) carry the lamp holder (3) to change its position accordingly.

The two rods of the connecting rod assembly (5) can be relatively adjusted to displace along to lower circular grooves (412) of the sockets (41) to simultaneously carry the shielding covers (43) of the rotary connectors (4) to rotate. During position adjusting operation, the link gears (6) help to stabilize the displacement of the connecting rod assembly (5).

What is claimed:

1. A desk lamp, comprising:

a base comprising a circular recess in its center having a round hole therethrough;

a rotary stand comprising a hemi-spherical shell having a cap secured thereto by means of bolts and nuts, said rotary stand being secured to said base and permitted to rotate on its own axis, said cap having a plane surface with a bolt hole made thereon;

a lamp holder having an axial hole therethrough with an internal circular groove made thereon for the insertion therein of an axle, said axle comprising a front rod portion having a circular groove with a rubber ring mounted thereon, said front rod being inserted in said axial hole with its rubber ring set in said internal circular groove permitting said lamp holder to rotate through an angle of 360° relative to said axle, said axle also comprising a plane surface having a bolt hole theren;

two pairs of rotary connectors each pair being respectively fastened to the plane surface of said cap and said axle, said rotary connectors each comprising an axle sleeve having an upper circular groove with a rubber ring mounted thereon and a lower circular groove, and a shielding cover covering on said axle sleeve, said shielding cover having two opposite axial holes thereon; and a connecting rod assembly adjustably connecting said lamp holder to said rotary stand and comprising first and second rods in parallel with each other and having both ends respectively secured to the axial holes of the shielding cover of said rotary connectors by means of bolts and movably positioned in the lower circular grooves of the sockets of said rotary connectors.

2. A desk lamp as claimed in claim 1, wherein two link gears each being comprised of a clamp and a retainer plate are used to link up the two rods of said connecting rod assembly with said rotary connectors in such a manner that the clamp of each link gear is mounted on the first rod of said connecting rod assembly while the associated retainer plate is secured to the bottom of the axle sleeve of the adjacent rotary connector to which the second rod of said connecting rod assembly is secured.

* * * * *